US007691006B1

(12) United States Patent
Burke

(10) Patent No.: US 7,691,006 B1
(45) Date of Patent: Apr. 6, 2010

(54) GOLF CLUB HEAD HAVING INTERCHANGEABLE AND WEIGHT DISPLACEMENT SYSTEM

(76) Inventor: William Burke, 70 Walnut St., Struthers, OH (US) 44471

( * ) Notice: Subject to any disclaimer, the term of this patent is extended or adjusted under 35 U.S.C. 154(b) by 0 days.

(21) Appl. No.: 12/070,834

(22) Filed: Feb. 22, 2008

(51) Int. Cl.
*A63B 53/04* (2006.01)

(52) U.S. Cl. ..... 473/288; 473/333; 473/342

(58) Field of Classification Search ..... 473/288, 473/342, 333
See application file for complete search history.

(56) References Cited

U.S. PATENT DOCUMENTS

| | | | | |
|---|---|---|---|---|
| 1,975,307 | A * | 10/1934 | Ackerman | 473/333 |
| 2,592,013 | A * | 4/1952 | Curley | 473/333 |
| 3,220,733 | A * | 11/1965 | Saleeby | 473/335 |
| 3,368,812 | A * | 2/1968 | Baldwin, Sr. | 473/330 |
| 4,461,481 | A | 7/1984 | Kim | |
| 4,884,808 | A * | 12/1989 | Retzer | 473/288 |
| 5,141,231 | A * | 8/1992 | Cox | 473/330 |
| 5,366,222 | A | 11/1994 | Lee | |
| 5,509,660 | A * | 4/1996 | Elmer | 473/288 |
| 5,890,973 | A * | 4/1999 | Gamble | 473/326 |
| 6,514,154 | B1 | 2/2003 | Finn | |
| 6,551,199 | B2 | 4/2003 | Viera | |
| 6,641,490 | B2 | 11/2003 | Ellemor | |
| 6,743,117 | B2 | 6/2004 | Gilbert | |
| 6,872,148 | B2 | 3/2005 | Lee | |
| 7,101,290 | B2 * | 9/2006 | Tucker, Sr. | 473/340 |
| 7,431,662 | B2 * | 10/2008 | Tucker et al. | 473/288 |
| 2002/0022532 | A1 * | 2/2002 | Tucker, Sr. | 473/288 |
| 2002/0137576 | A1 | 9/2002 | Dammen | |
| 2007/0087860 | A1 * | 4/2007 | Chen et al. | 473/333 |

* cited by examiner

*Primary Examiner*—Stephen L. Blau
(74) *Attorney, Agent, or Firm*—Harpman & Harpman

(57) ABSTRACT

A golf club having multiple interchangeable striking face plate inserts and a movable weight element positioned therewithin. A number of different angularly inclined striker face plates are keyed to a club head body allowing the club to function as a multiple club configuration. Adjustable weight inserts are provided which impart their kinetic energy during the club swing to increase striking power of the club with the target ball during use.

3 Claims, 3 Drawing Sheets

GOLF CLUB HEAD HAVING INTERCHANGEABLE AND WEIGHT DISPLACEMENT SYSTEM

BACKGROUND OF THE INVENTION

1. Technical Field

This invention relates directly to golf clubs, specifically golf club heads which have enhanced structural performance characteristic and play features.

2. Description of Prior Art

Golf clubs have, in recent years, undergone a variety of technical improvements to enhance the performance characteristic of the golfer's play. Many significant improvements have been made concerning the material used in the golf heads as well as redistribution of weight or mass within the club itself. It has been found by providing additional weight or weight that is active, such clubs have improved performance, specifically in the length of the drive which is important and critical in the game of golf.

Other technical improvements include the reduction of weight in the golf club head to increase club head speed and presumably accuracy in relation to the sweet spot of the club to impart optimal projectory and distance of the ball.

Prior art devices of this type can be seen, for example, in U.S. Pat. Nos. 4,461,481, 5,366,222, 6,514,154, 6,641,490, 6,551,199, 6,872,148, 6,743,117 and U.S. Patent Publication 2002/013576 A1 and 2007/0087860 A1.

In U.S. Pat. No. 4,461,481 a golf club device is disclosed and directed towards having a cylindrical weight slidably positioned within the club head for improved ball striking capabilities.

U.S. Pat. No. 5,366,222 discloses a golf club head having a head cavity with a movable weight positioned within.

U.S. Pat. No. 6,514,154 claims a golf club having an adjustable weight rotatably mounted within a threaded bore.

U.S. Pat. No. 6,641,490 shows a golf club head with a U-shaped hollow passageway in which a flowable solid is captured.

U.S. Pat. No. 6,551,199 an inertia capsule for a golf club is described having an elongated capsule filled with mercury that is flowably disposed during use, transferring mass appropriately therewithin.

A golf club in U.S. Pat. No. 6,872,148 has a movable member with an explosive charge in the head which activates during club head movement.

U.S. Pat. No. 6,743,117 claims a golf head with a multiple face insert that can be replaceably inserted on the club head.

U.S. Patent Publication 2002/2013576 A1 discloses a golf club head with an adjustable weight having a pair of tubular weight receiving chambers within.

Finally, U.S. Patent Publication 2007/0087860 A1 illustrates a golf club head having an enlarged striking power by use of multiple spring loaded weight elements with corresponding guide bores.

SUMMARY OF THE INVENTION

A dynamic golf club driver system having club heads with movable weights in a central bore and interchangeable club head face inserts. The weight is movable against the club head face insert that is selectively engaged and locked into use position by releasable fasteners. Different weight mass elements can be used depending on force enhancement required. Additionally, the face inserts have multiple configurations with different angular imparted target strike surface to emulate different club performance in a single interchangeable club configuration system.

DETAILED DESCRIPTION OF THE INVENTION

Figure 1:
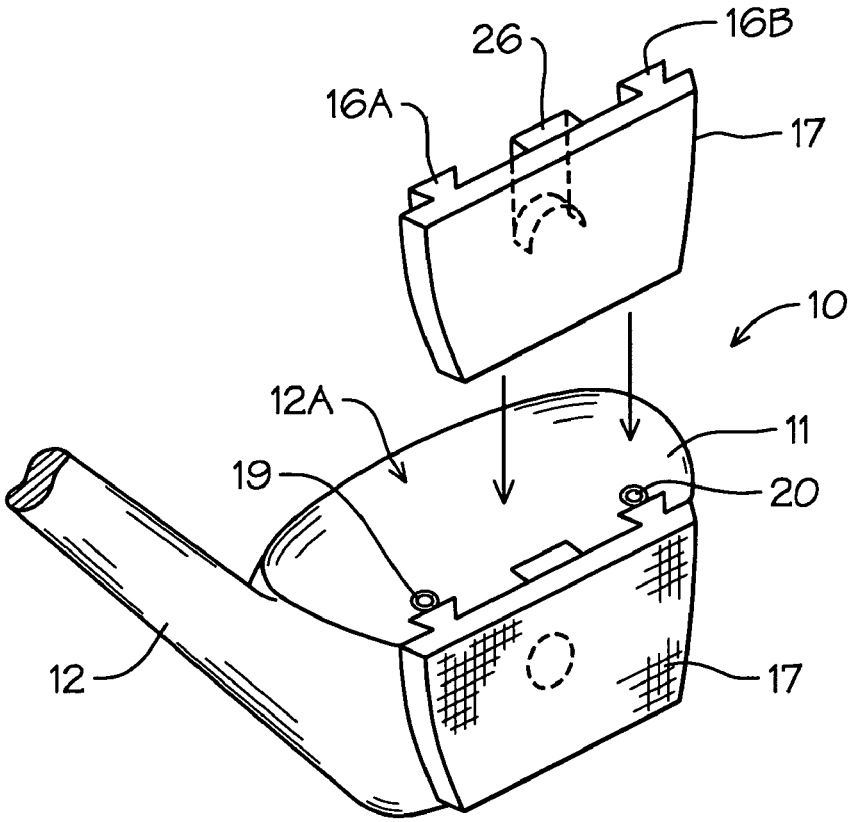
FIG. 1 is a perspective view of the club head of the invention with a face insert shown in broken lines positioned for insertion.
Figure 2:
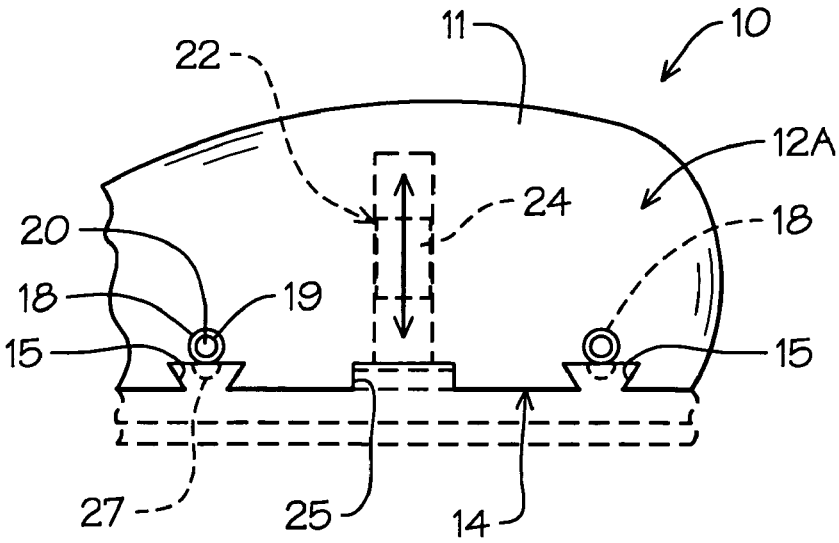
FIG. 2 is a partial top plan view of a club head of the invention with interchangeable dynamic striker face plates shown in broken lines.
Figure 3:
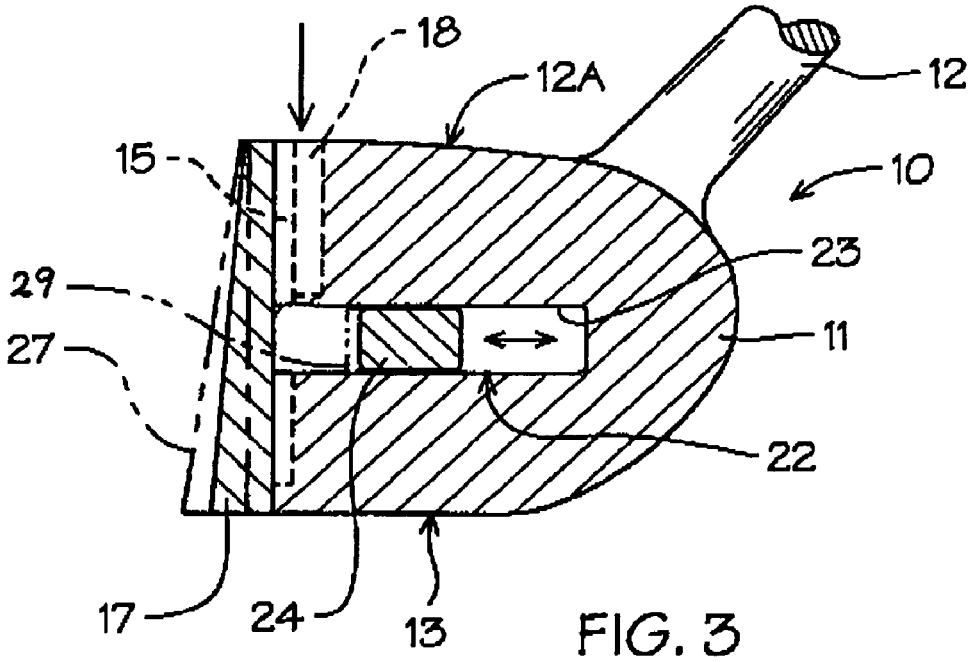
FIG. 3 is a sectional view of the club head of the invention with alternate interchangeable striker plates shown in broken lines.
Figure 4:
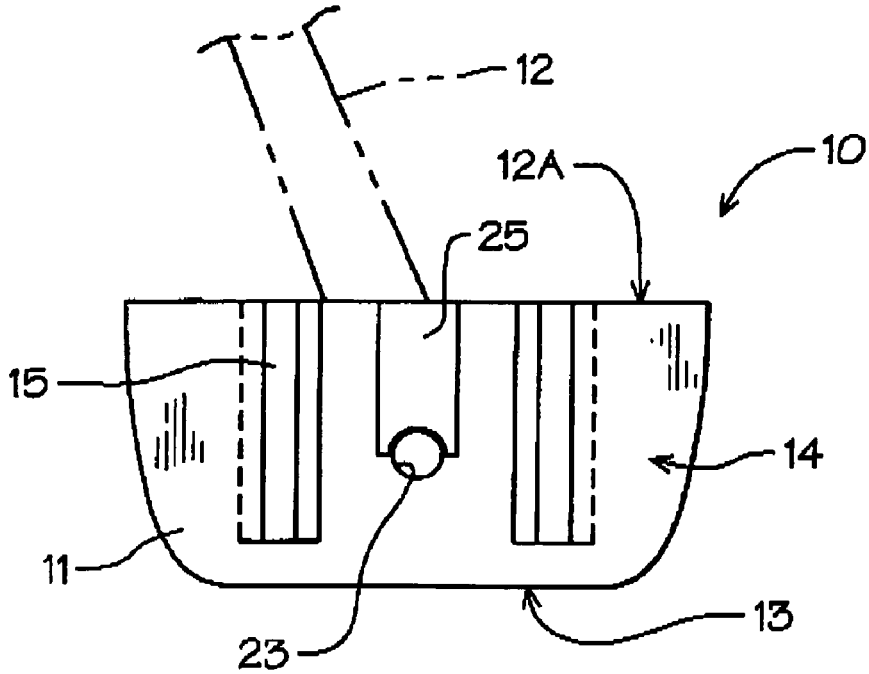
FIG. 4 is a front elevational view of the club head body of the invention.

Referring to FIGS. 1, 2 and 3 of the drawings, a golf head 10 of the invention can be seen having a main body member 11 with an attached club shaft 12 extending therefrom. The main body member 11 has an upper access surface 12A, oppositely disposed bottom 13 and a club face surface 14. A pair of spaced parallel vertical mounting channels 15 are formed in the club face surface 14 and extend from the upper surface 12A to a point in spaced relation to the bottom 13, as best seen in FIG. 3 of the drawings.

Each of the mounting channels 15 are keyed to accept a corresponding elongated key shaped flanges 16A and 16B formed on an interchangeable ball striker plate 17 as will be described in greater detail hereinafter.

Figure 5:
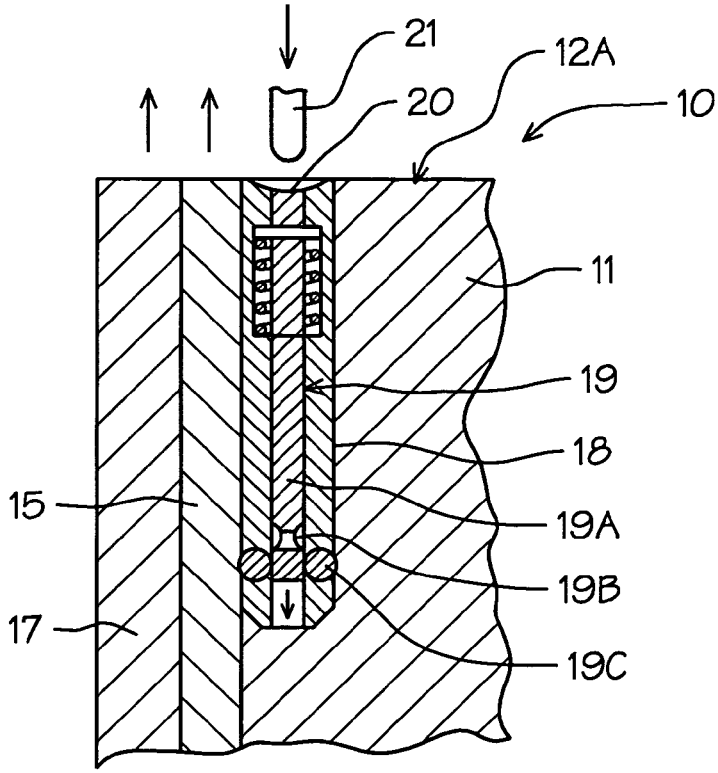
FIG. 5 is an enlarged partial sectional view illustrating the lock and release pin mechanisms of the club head of the invention.
Figure 6:
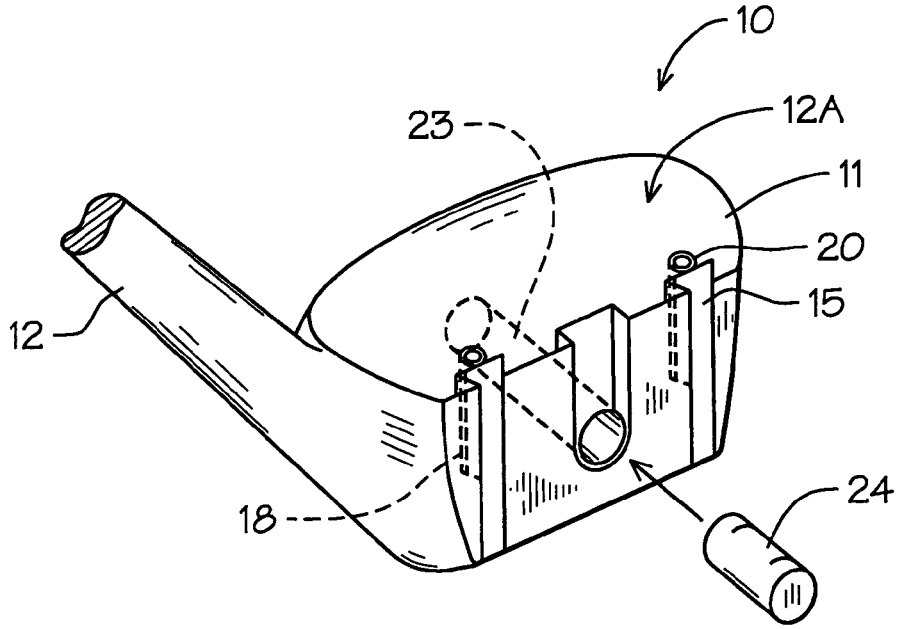
FIG. 6 is an enlarged partial perspective view of an alternate club head of the invention.

A locking pin registration bore 18 extends from the upper surface 12 adjacent to and intersecting each of the hereinbefore described key mounting channels 15. A pair of releasable locking pin assemblies 19 are frictionally fit respectively into the registration bores 18 with each having a spring loaded activation and release shaft 19A with an area of reduced annular diameter at 19B. A pair of locking spheres 19C are movable transversely within the locking pin 19 in relation to the orientation of the release shaft 19A and extend outwardly beyond the annular surface thereof so as to registerably engage with a corresponding shaped detent formed in the interchangeable ball striker plate 17 as best seen in FIG. 5 of the drawings. The locking pin assemblies 19 allow for selective depression of the shaft 19A via an end access point 20 with an activation release tool 21. The construction and function of such locking pin assemblies 19 are well known and understood by those skilled in the art and are commercially available from a variety of manufacturing sources such as the Jergens Company of Cleveland, Ohio.

A club head acceleration assembly 22 is positioned within the club body member 11 having a slide bore 23 extending horizontally from the club face surface 14 inwardly a predetermined distance, best seen in FIG. 3 of the drawings. The slide bore 23 provides a track pathway for a movable weight 24 which is of an annular transverse dimension less than that of the interior dimension of the slide bore 23 so as to freely be movable therewithin. The drive weight 24 is of multiple weight configurations and lengths so that the user can select and insert different weights depending on the club configuration used. A vertical indexing slot 25 is formed within the club mounting face surface 14 between the keyed mounting channels 15 intersecting the slide bore 23 to provide registration clearance for the interchangeable club striker plate 17, best seen in FIGS. 1 and 3 of the drawings.

The club striker plates 17 are of a generally rectangular configuration shaped to conform with the outer edge diameter of the club body mounting face 14. The striker plates 17 have as previously described a pair of spaced parallel registration locking key flanges 16A and 16B extending therefrom with a central indexing tab 26 therebetween. The locking key flanges 16A and 16B are registerably disposed within the corresponding key mounting channels 15 by vertical insertion with locking pin registration detents 27 therewithin for engagement with the hereinbefore described locking spheres 19C of the locking pins 19 as best seen in FIG. 5 of the drawings. The striker plates 17 have a variety of different target surface angular inclinations indicated by broken lines at 17A in FIG. 3 of the drawings. This variation in target angle surface allows the player, not shown, to select a different club face angle emulating different club heads and inserted in a common drive head 10 of the invention. The striker plates 17 will automatically lock in place for containment of the selected and inserted movable acceleration weight 24 as previously described.

In use, as the golf head club 10 of the invention is swung back through its arc, the movable weight 24 will initially move within the bore against the striker plate 17 and then at the termination of the back swing be repositioned to the distal end of the slide bore. As the club head 10 is then accelerated forward in the travel path of the club and engages the target (golf ball not shown) the weight 24 will slide forward striking the striker plate 17 adding additional kinetic energy to the club head with additional thrust imparted to the target for a longer drive which is advantageous in the game of golf.

To replace the striker plate 17 and gain access to the slide bore 23 and weight 24 for selective removal and replacement, if required, the release tool 21 is placed against the respective lock pins engagement surface 20 depressing the release shaft 19A allowing the area of reduced transverse dimension on the shaft to be aligned with the spheres 19C thus releasing the striker plate 17 allowing it to be retracted vertically out of the keyed mounting channels 15. Once removed, it will be evident that the weight 24 can be removed and replaced, if required, within the slide bore 23 and a different striker plate, for example, having a different angular face inclination can be reinserted and locked into place in the reassembled club head 10 of the invention.

It will be seen that an alternate form of the invention in FIG. 3 of the drawings in which a shock reduction insert 29 indicated by broken lines is secured to the face impact surface of the movable weight 24. The insert 29 is of a synthetic resin material that will allow kinetic energy transfer to the striker plate while absorbing the material impact shock that could damage the striker plate material.

It will thus be seen that a new and novel interchangeable club head 10 of the invention has been illustrated and described and it will be apparent to those skilled in the art that various changes and modifications may be made thereto without departing from the spirit of the invention.

I claim:

1. A golf club including a shaft and a club head, an interchangeable golf head striker plate selectively secured to said club head, said striker plate having an angularly inclined target engagement surface, a weight freely slidably positioned within a bore in said club head extending inwardly from said striker plate from a first non-contact position to a second contact position with said striker plate, said weight is selected from a group having various masses and size, an energy absorbing insert on an impact surface of said movable weight, selectively securing said striker plate to said club head by interchangeable key flanges and locking means.

2. The golf club set forth in claim 1 wherein said locking means for selectively securing said striker plate to said club head comprises, locking pin assemblies in said club head registerable with said key flanges during insertion therewithin.

3. The golf club set forth in claim 1 wherein said weight further comprises a striker surface insert of hardness less than that of said known hardness of said weight material.

* * * * *